United States Patent [19]

Gladwin et al.

[11] 4,005,789

[45] Feb. 1, 1977

[54] TRASH COMPACTOR TRAILER

[75] Inventors: Floyd R. Gladwin, Grosse Ile, Mich.; Robert B. Packard, Toledo, Ohio

[73] Assignee: Gladwin Corporation, Southgate, Mich.

[22] Filed: Aug. 27, 1975

[21] Appl. No.: 608,181

[52] U.S. Cl. ..... 214/82; 214/83.3

[51] Int. Cl.[2] ..... B65F 3/00

[58] Field of Search ..... 214/82, 83.3, 503, 518; 100/233

[56] References Cited

UNITED STATES PATENTS

| | | | |
|---|---|---|---|
| 3,447,700 | 6/1969 | Nickel | 214/83.3 X |
| 3,462,031 | 8/1969 | Weir | 214/83.3 X |
| 3,486,644 | 12/1969 | Bakker et al. | 214/83.3 X |
| 3,841,505 | 10/1974 | Kent | 214/82 |

*Primary Examiner*—Albert J. Makay

*Attorney, Agent, or Firm*—Cullen, Settle, Sloman & Cantor

[57] ABSTRACT

A trash compactor formed of a box-like body mounted upon wheels to provide a trailer for towing by a vehicle. The body forward and rear ends are open and doors cover each end, with each door being pivotally mounted at its upper end for swinging forwardly and rearwardly. The forward door swings interiorly of the body, as well as forwardly. The body floor is formed with an arcuate shaped portion corresponding to the path of swinging movement of the lower end of the forward door and then with a downwardly sloped portion extending to the rear opening. Trash may be deposited upon the arcuate floor portion and from time to time swept rearwardly and compressed by the interior swinging of the forward door and then stored in the sloped floor area of the body for later dumping by opening the rear door.

2 Claims, 8 Drawing Figures

FIG. 1
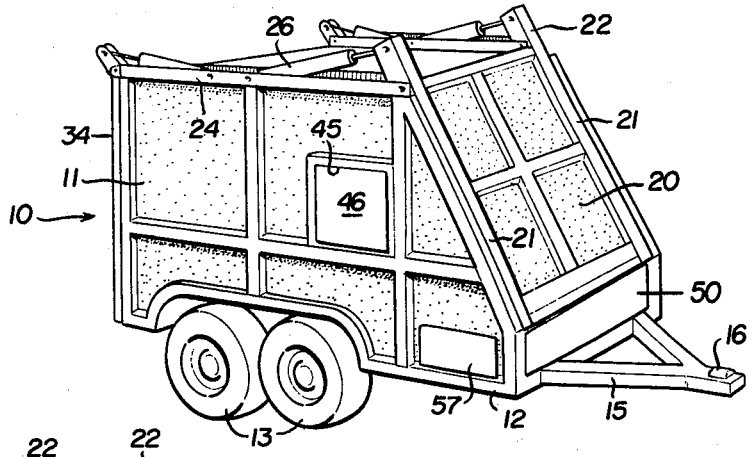
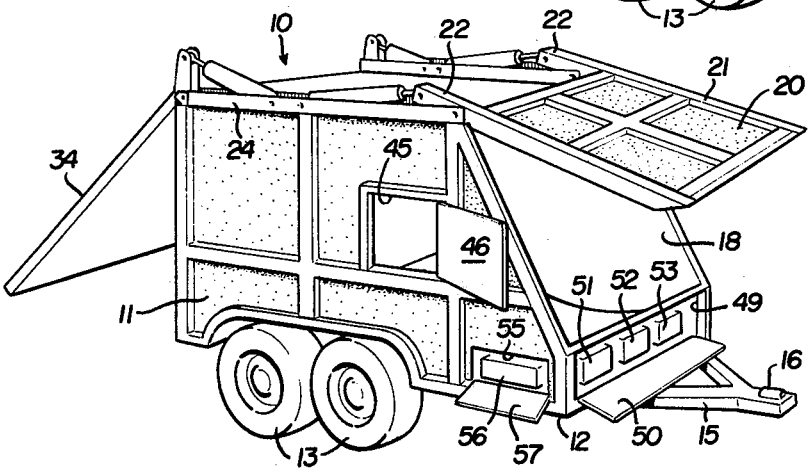
FIG. 2
FIG. 3
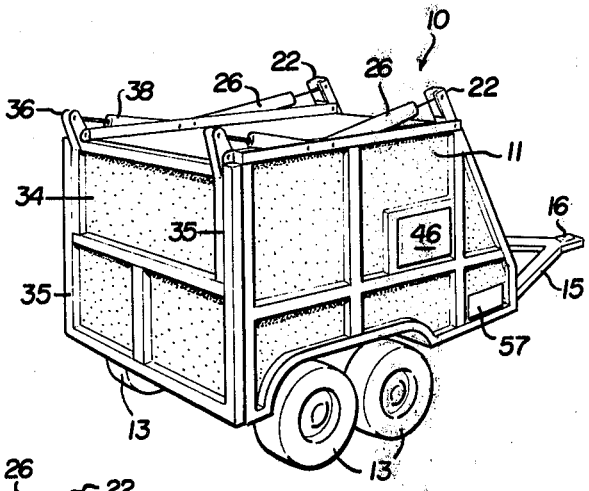
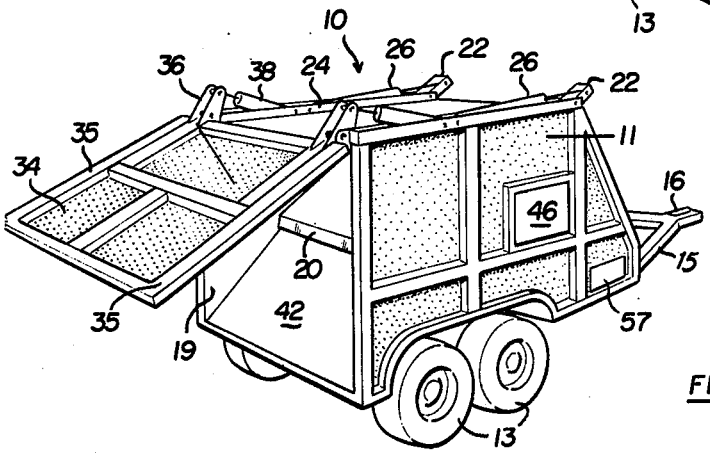
FIG. 4

TRASH COMPACTOR TRAILER

BACKGROUND OF INVENTION

Two types of trash compressors or compactors have been available. One type is a stationary compactor which is permanently located in an area of use and into which trash is deposited for compressing or compacting. The compacted trash is then removed from the compactor for disposal. Another common type consists of the various compactor mechanisms which have been utilized in connection with so-called garbage trucks which pick up trash and compress the trash within the garbage truck body in order to reduce the volume of the trash and permit greater loads.

However, for certain uses, it is desirable to combine the advantages of a stationary trash receiving compactor with the advantage of mobility of the garbage truck for ease of disposal of the trash. For example, it would be desirable to have available at a campground or at an amusement park or fair, etc., a large receptical for receiving and compacting trash and which receptical may be conveniently kept on site for as long as desired and then easily moved, with its contents to a dumping or disposal area for removal of the compacted trash. Thus, the invention herein relates to a trailer compactor which includes a large body for receiving trash easily, a means for compacting the trash for increasing stored capacity and a means for attaching the trailer to a vehicle for movement to a disposal area for easy dumping of the compacted trash. This eliminates the need for manually unloading a stationary compactor and carrying the compacted trash away in another vehicle, with the required labor for transferring from one to the other, as well as eliminating the very substantial expense of a garbage truck which obviously cannot be left on site for any length of time but rather must be continuously used.

SUMMARY OF INVENTION

The invention herein contemplates a trailer type compactor including a large, box-like body mounted upon wheels and having a conventional trailer attachment for towing by vehicles, such as light trucks or station wagons, etc. The body is formed with an open forward and rear end each of which is covered by a swinging door which swings forwardly and rearwardly. The forward door is made to swing interiorly of the body for compacting trash, as well as forwardly for opening the body.

The floor of the body is formed with an arcuate shaped portion corresponding to the arc of movement of the lower end of the forward door, and also a downwardly sloped portion at the rear door. Thus, trash may be deposited into the body upon the arcuate floor, either through the front end opening when the door is opened, or alternatively through a side access door and, from time to time, the forward door may be actuated by a power mechanism for sweeping the trash upon the arcuate floor rearwardly and simultaneously compressing it into the rear portion of the body located above the sloped floor.

When the body is sufficiently filled with compacted trash or when the device is no longer needed at the particular site, a tow vehicle may be attached to the trailer hook-up for moving the compactor either to a dump area or to a new site, as required.

For dumping purposes, the rear door serves as a rear wall of the body, which when opened, permits the compacted trash to slide down the rear sloped floor portion for dumping the contents.

The compactor may serve many different types of areas where a relatively inexpensive, large capacity, on site or mobile unit is useful. Because of its construction, trash inserted therein is completely enclosed and confined against either disturbance by animals or wind blowing, etc. Moreover, being of simple construction and operation, with relatively few moving parts, it may be easily operated by one man and the trash may be inserted by anyone, including children, with safety.

These and other objects and advantages of this invention will become apparent upon reading the following description, of which the attached drawings form a part.

DESCRIPTION OF DRAWINGS

FIG. 1 is a perspective view of the trailer compactor showing the front end thereof.

FIG. 2 is a view similar to FIG. 1, but showing all of the various doors open.

FIG. 3 is a rear perspective view.

FIG. 4 is a rear perspective view with the rear door open for dumping.

DETAILED DESCRIPTION

The trailer trash compactor, generally designated as 10, is formed of a box-like body 11, preferably constructed of steel frame members and sheet of sufficient strength and rigidity for the purpose herein. The details of construction of the body itself may vary and is within the skill of the art.

Figure 5:
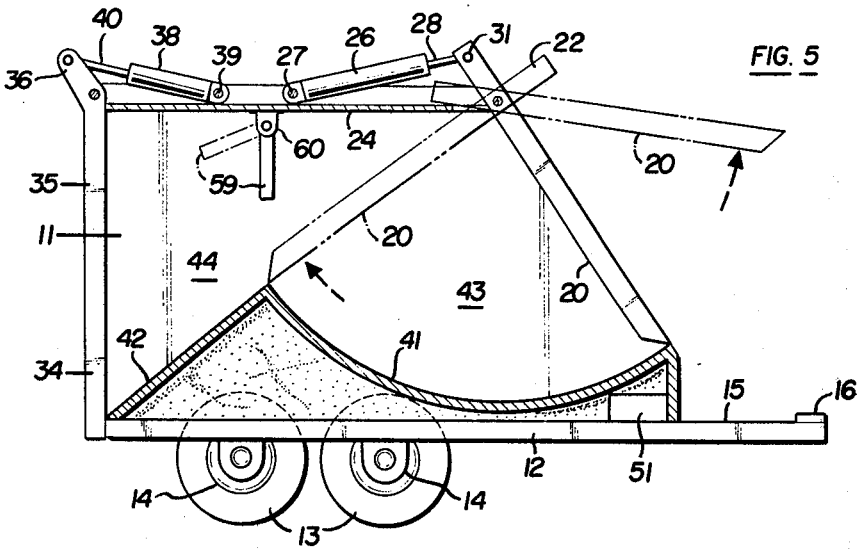
FIG. 5 is a cross-sectional, schematic, elevational view and shows, in dotted lines, the operation of the forward door.
Figure 6:
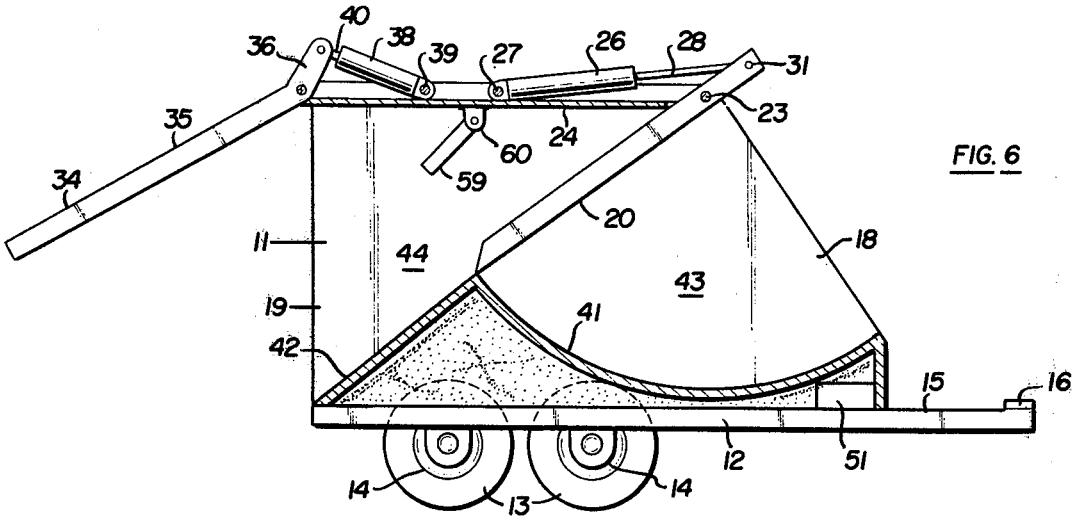
FIG. 6 is a cross-sectional, schematic, view similar to FIG. 5, showing the forward and rear doors in dumping position.
Figure 8:
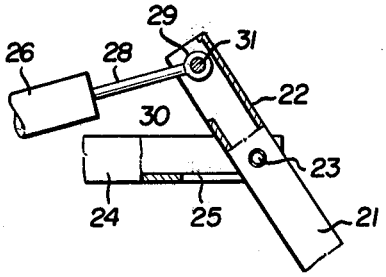
FIG. 8 is an enlarged, cross-sectional view of a fragment of the operating mechanism.
Figure 7:
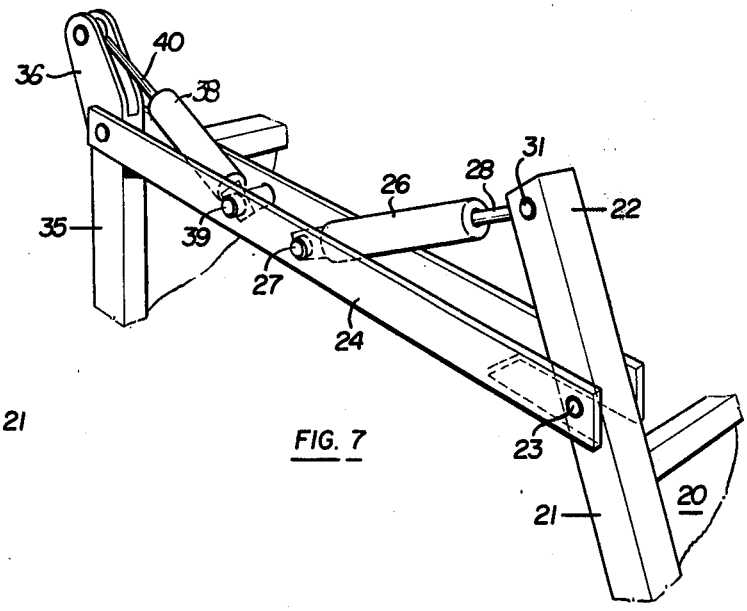
FIG. 7 is an enlarged, cross-sectional fragmentary view of the operating mechanism for swinging the forward and rear doors.

The body is mounted upon a suitable trailer type frame 12 (see FIG. 5) having wheels 13 connected thereto by conventional trailer wheel mountings 14 (shown schematically in FIG. 5).

Attached to the frame is a conventional trailer draw tongue or bar 15 carrying a conventional hitch or attachment 16 for releasable attachment to the corresponding part of a tow vehicle.

By way of example of size, a trailer trash compactor as described herein was constructed with an overall length of about 14½ feet, and an overall height of about 8 feet, with about 1 foot ground clearance and a width of about 6 feet, and a net weight of about 2½ tons to thereby provide an approximate 8 cubic foot capacity. Of course, the size and weight may vary depending upon the desired capacity and strength.

The box forward end 18 and rear end 19 are open, and the forward end preferably is sloped relative to the vertical whereas the rear end is approximately vertical.

A forward door 20 closes the open end 18. This door is made of a heavy construction with heavy, tubular, side frame elements 21 having upper extensions 22 extending above the height of the door and connected by pivots 23 to the ends of channels 24 which form the upper corner frame members of the body. The extensions fit into slots 25 formed in the ends of the channels.

The door is sized to fit interiorly of the body as well as to swing forwardly of it. To hold the door in its closed position as well as to swing it, a power means is provided. This includes hydraulic cylinders 26, each connected by a pivot pin 27 within the channel 24 and with its piston rod 28 having a journal forming end 29 extended through a slot 30 in the frame element extension for receiving a swivel pin 31. The power cylinder may be actuated by a conventional hydraulic system for causing its piston rod to either retract or extend from the cylinder to thereby apply a force to the door upper extensions and thereby cause the door to swing in the corresponding direction of the force.

The rear open end 19 of the box is closed with a vertically arranged rear door 34, having side frame elements 35, which preferably are of steel tubing, as in the case of the forward door, which elements are also provided with upwardly extending extensions 36 connected by pivots 37 to the opposite ends of the channels 24.

The rear door is operated by power cylinders 38 which are connected by pivot pins 39 to the respective channels and with their piston rods 40 connected to similar swivel pins formed in the door extensions. The rear door acts as a closure, that is, it remains closed at all times except for dumping purposes. In constrast, the forward door functions as both a closure as well as a compressor. That is, it may be pivoted forwardly to open the front end for depositing trash into the box, or alternatively, it may be swung rearwardly for compressing or compacting the trash in a manner to be described below. The floor of the box-like body is formed with a forward, arcuately shaped floor portion 41 and a rearwardly, downwardly sloped portion 42. The arcuate shaped portion corresponds to the arc of movement of the lower, free end of the forward door which swings adjacent it for sweeping trash rearwardly.

The arcuate shaped floor portion divides the body into a trash recepticle area 43, with the sloped floor portion providing above it a compression-storage area 44. A side access opening 45 in the body, having a suitably hingedly mounted closure door 46 provides access for depositing trash into the recepticle area as an alternative to swinging the forward door upwardly to open the front end.

Beneath the arcuate floor portion is a forward compartment 49 closed by a swinging door 50 for containing a small gasoline type engine 51 for operating a compressor pump 52 to operate the power cylinders utilizing oil or similar fluid normally contained in a fluid sump 53. The engine, compressor, fluid pump and fluid reservoir or sump are all shown schematically, since these are conventional, commercially available devices. The hydraulic lines interconnecting the pump and cylinders are conventional and thus, omitted from the drawings.

Preferably, the operating controls and starting controls 56 are located in a side compartment 55 which is normally covered with a swinging door 57 hingedly connected to the body. Thus, the operator must be located at the side of the body, out of the way of the door movement.

The power system contemplated, i.e., the conventional engine, fluid pump, power cylinder, operating controls and hydraulic lines, etc., are interchangeable with various commercial sizes and makes on the market. Hence, no further description of this system is deemed necessary to those skilled in the art and hence, is eliminated herein.

In operation, the trailer is towed to a site where it is to be used, such as at an amusement park or fair or in a camping grounds, recreational area, etc. The tow vehicle may be disconnected and the trailer left parked on site.

While parked, trash may be thrown into the body through the side access opening 45 by merely opening the door 46. Alternatively, trash containers, such as garbage cans, and the like, may be emptied into the open forward end of the body by elevating or swinging forwardly the forward door. From time to time, as the recepticle area begins to fill with loose trash, an operator turns on the engine to start the power system and by actuating the power cylinders 26, causes the forward door to pivot rearwardly, as shown in dotted lines in FIG. 5 for sweeping the loose trash toward the rear of the body and simultaneously compressing it upwardly against the roof of the body and also against such trash as is already compacted. The compressed trash remains in the rear portion of the body and the forward door swings back into its normal position again, so that further loose trash may be thrown into the body.

In order to avoid compacted trash, particularly when the pile is high, from returning back into the arcuate floor area, a number of parallel depending bars or a single depending plate 59 connected by a pivot bracket 60 to the roof of the box, acts as a barrier to the forward return of the compacted trash. The bars or plate are pivoted to swing upwardly towards the rear but to stop in the vertical position, that is, not swing forwardly.

The compressive force of the forward door against the trash is also transmitted to trash located rearwardly of that door, as the amount of trash increases, so that the trash is repeatedly and further compacted each time the door is operated for compressive purposes. Ultimately, when the body is sufficiently filled with compacted trash, the tow vehicle may be hitched to the trailer hitch and the compactor towed to a dump site. There, the rear door is unlatched and swung open and the forward door is swung toward its interior position with the result that the contents are dumped through the open rear end. Then, the rear door may be closed again and the forward door returned to its normal position and the trailer towed back on site for further use.

Because the cylinders and doors are pivotally connected to the upper, horizontal channels 24, reaction forces due to operation of the doors are transmitted through and substantially absorbed by such channels. Hence, by using strong enough channels, the strength requirements on the remainder of the box construction elements is reduced, permitting a less expensive overall construction.

Because of its relatively low cost and small size, as compared to a normal garbage truck, the trailer may be used as a small garbage truck for receiving and compating trash in areas where a full size garbage truck is not economical. For example, in resort areas or motel areas where it may be necessary to collect trash at various spaced apart points, but where the quantity and timing of collection does not warrant normal garbage pick-up, the trailer herein may function as a garbage truck temporarily by merely hooking it onto a tow vehicle and driving it about.

Having fully described an operative embodiment of this invention, I now claim:

1. In a trash compactor comprising a box-like body mounted upon wheels for forming a trailer for towing behind a vehicle, said body including a roof, a floor, and first and second open ends, first and second doors closing each of said open ends, respectively, each door being swingably mounted at its upper end to said roof for pivoting about a horizontal axis, and actuatable means for swinging said doors and for holding them in closed positions, the improvement comprising:

the first end of said body being sloped downwardly and forwardly at an acute angle and said first door normally being positioned for closing the open first end;

said first door actuated for swinging outwardly to open said first end of said body;

said second door actuated for swinging outwardly to open the second end of said body;

said floor being arcuately shaped from said body open first end to a location intermediate said body ends to define a loading compartment for trash interiorly of said body;

said floor being thereafter sloped downwardly to said body open second end to define a trash storage compartment interiorly of said body; and said first door also actuated for swinging through said trash loading compartment to sweep and compact trash generally upwardly against said roof, said compacted trash thereafter falling into said trash storage compartment;

said arcuate floor shape corresponding to the arcuate path of movement of said first door interiorly of said trash loading compartment;

an upwardly extending member formed on each of the upper corners of the door, and each having a fluid operated cylinder having a piston rod connected to each of said frame members and each cylinder being pivotally connected within a channel extending along the upper side edges of the body, with each channel forming an upper frame member for the body at each side of the body, and each of said upwardly extending members being pivotally connected to its adjacent channel portion;

wherein forces of moving the doors and for compacting the trash are transmitted through and absorbed by the channels; and deflector means suspended from said roof interiorly of said body to preclude compacted trash from returning to said trash loading compartment.

2. A construction as defined in claim 1, and including an access opening formed in the side of the body in the area above the arcuately shaped floor and normally closed by an access door for use in depositing trash into the body.

* * * * *